United States Patent [19]

Groothuizen

[11] Patent Number: 4,623,561

[45] Date of Patent: Nov. 18, 1986

[54] METHOD OF MARKING A HOT STEEL SLAB

[75] Inventor: Jan C. Groothuizen, Wijk aan Zee, Netherlands

[73] Assignee: Hoogovens Groep B.V., Ijmuiden, Netherlands

[21] Appl. No.: 754,730

[22] Filed: Jul. 15, 1985

[51] Int. Cl.[4] ..... B05D 3/00; B05D 1/02

[52] U.S. Cl. ..... 427/275; 29/81 B; 72/39; 427/287

[58] Field of Search ..... 29/81 B; 427/287, 327, 427/275; 134/15; 72/39, 46

[56] References Cited

U.S. PATENT DOCUMENTS 3,543,775 12/1970 Bodnar ..... 134/15 X
3,826,681 7/1974 Vialle et al. ..... 427/327
4,233,830 11/1980 Houdion ..... 29/81 B X

FOREIGN PATENT DOCUMENTS 1043954 12/1978 Canada .
51-5821 2/1976 Japan ..... 72/39
1534651 12/1978 United Kingdom .
1541732 3/1979 United Kingdom .

OTHER PUBLICATIONS

"Automatic Hot Slab Spray Marker in Continuous Casting Lines", Sato et al, from Kawasaki Steel Technical Report No. 1, Sep. 1980, pp. 89–93.

*Primary Examiner*—Evan K. Lawrence
*Attorney, Agent, or Firm*—Stevens, Davis Miller & Mosher

[57] ABSTRACT

A method of applying a visible mark on a hot steel slab is described. The adherence of the marking composition to the slab surface can be improved by removing locally iron oxide therefrom, followed by the step of locally cooling down the surface to prevent secondary oxide growth. This is done by first directing a water jet of high pressure at an acute angle to the slab surface immediately followed by a gentle water stream of low pressure. After this conditioning of the surface, the mark can be sprayed thereon.

6 Claims, 6 Drawing Figures

METHOD OF MARKING A HOT STEEL SLAB

BACKGROUND OF THE INVENTION

1. Field of the Invention

The invention relates to a method of applying a visible mark on one side of a hot steel slab.

2. Description of the Prior Art

A conventional way to mark a hot steel article is by writing by hand on the surface with a chalk stylus or waxy crayon that melts at high temperatures and leaves a permanent mark. This marking of a hot article is unsatisfactory because of the proximity of the person making to the hot article and the attendant danger to health which can lead to fatigue, inattentiveness and wrong marking. Because the work is monotonous the risk of errors is increased. When markings are absent, an ingot, bloom or slab is not indentifiable and is therefor declassified which involves a significant economic loss. Also the labour costs are high with such a method.

With an integrated steelplant a visible product-identification for the material flow between the steelplants and the rolling mills prevents interchanges of subjects.

Canadian patent specification No. 1043954 a method of applying a marking composition to a surface of a hot iron or steel article which composition is a dry powder suitable for application to the hot metal surface in dry powder form and consists of three components, which are a pigment, aluminium and adhesion agent, the aluminium powder serving to reduce the primary rolling oxide of iron, on the hot metal surface, thereby preventing or minimizing subsequent flaking off of the mark with underlying rust. The adhesion agent being effective to cause adhesion at a temperature which is not lower than 200° C. The marking material adheres reliably and sufficiently tenaciously to survive subsequent treatment. The marking material can be applied by means of simple equipment and in a manner which permits the operator to be in a sufficient distance from the article for safety. The powder used in this known method should be in dry state and also the compressed air for its carrier gas jet is preconditioned to render it dry, so that during the marking on the hot metal no steam will be formed.

British patent specification No. 1534652 describes a method and apparatus for marking a hot steel slab on a roller table wherein the slab is previously scanned for the presence of doublings or other defects in the head and/or the tail thereof. In that method the slab is brought to a standstill on the roller table and at a relevant place or places on information derived from the scanning is provided with a visible mark by pneumatically projecting heat resistant marking powder only one side of the slab.

British patent specification No. 1541732 describes a method of applying a water based paint marking to a hot metal surface which comprises locally cooling the surface and applying the point marking to the locally cooled area. When an attempt is made to apply water based paint to a metal surface the temperature of which exceeds 900° C., the paint does not mark the surface. This is due to film boiling of the paint. When the metal surface temperature on which the paint is being applied is below about 800° C. the boiling becomes nucleate and paint particles can penetrate to the surface of the metal. Local cooling is preferably effected by two jets of air through two spaced cooling nozzles and the paint is preferably applied by a paint nozzle spraying through a stencil.

SUMMARY OF THE INVENTION

To prevent interchanges in the material flow between the steelplants and the rolling mill departments, a quick legible product identification using any combination of numbers and/or letters on the products should be designed to avoid errors, as their effects can be both serious and costly. Moreover, the numbering system to identify products more or less temporarily should be designed ergonomically in order to identify possible errors and to reduce their frequency of occurrence.

It is an object of the invention to minimize errors caused by flaking off oxide layers from the slab surface.

To that effect, in a method of marking a hot steel slab, firstly a chosen surface region at a side of the slab is descaled by directing a water jet of high pressure at an acute angle to said surface region in order to remove locally iron oxide therefrom, which step is followed by the step of cooling down the so descaled surface region below 900° C. by directing a gentle water stream at a low pressure in order to prevent secondary oxide growth, and by the step of spraying a water based marking composition in the required pattern on said descaled and cooled down surface region at the said side of the slab.

As by cooling down the said surface region has reached such a low temperature at which secondary scale will not be formed so rapidly, there is no need to use dry powder and a paint/water mixture can be used.

BRIEF DESCRIPTION OF THE DRAWINGS

A preferred embodiment of the present invention will now be described, by way of non-limitative example, with reference to the accompanying drawings, in which:

FIG. 2*a* at the side, FIG. 2*b* at the tail and FIG. 2*c* at the head of the slab;

DESCRIPTION OF THE PREFERRED EMBODIMENT

Figure 1:
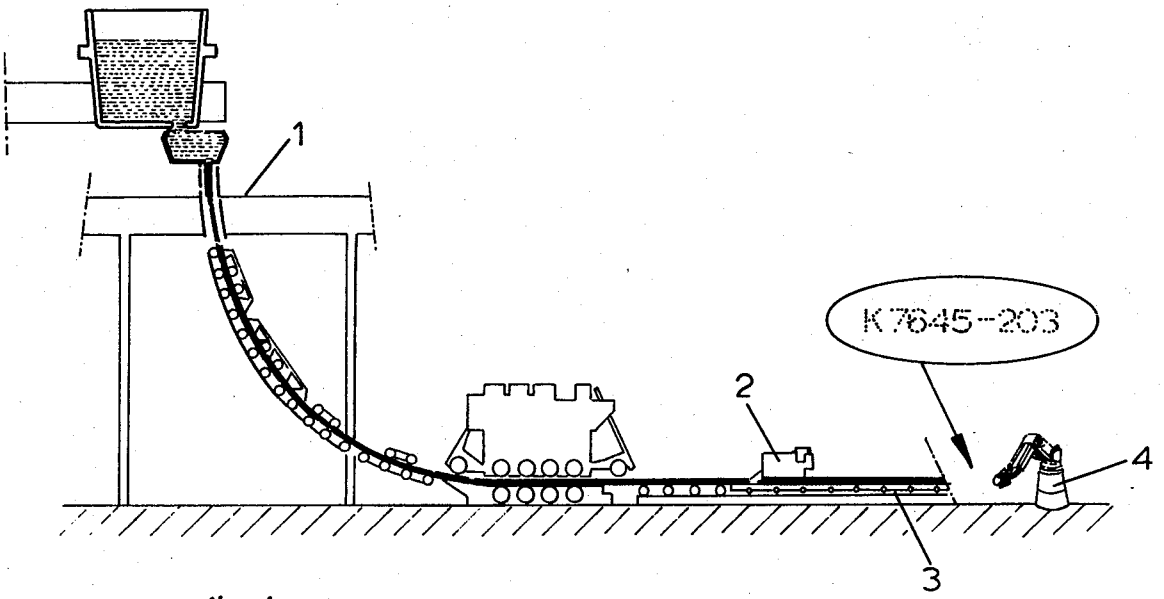
FIG. 1 is a schematic side elevation of a continuous caster for steel slabs with a cutting torch device, a roller table and a marking apparatus in the form of a reprogrammable manipulator (an industrial robot) installed along the roller table.

FIG. 1 shows in side elevation a continuous slab caster 1, which machine is provided with the usual cutting torch device 2, from which a cut slab is carried to a roller table 3. Only the beginning of the roller table 3 has been shown. A marking apparatus 4 is installed along the roller table 3, which apparatus 4 should perform the following functions:

detect the presence of a slab on the roller table,
scan the temperature of the slab,
descale a surface region at its side,
cool same region down to such a temperature at which no iron oxide is rapidly formed,
spray a mark on said region.

The time available for all these functions is relatively short and amounts as an average to only 60 seconds.

As the weight of the slab is about 14 metric tons and the average temperature is about 1100° C. or more, its heat content is very high, so that in a very short time the descaling and the cooling down should take place. To descale the chosen surface region use is made of a water jet at a high pressure, which jet is moreover directed at an acute angle of about 15° with the surface and has a flat form, which is obtained by using a flat jet nozzle. The high pressure is at least 150 bar, preferably even 190 bar. The flat shape and the acute angle of 15° of the high pressure jet contribute to an easy peeling off of the oxide layer from the slab. Immediately after the descaling the said surface region is cooled down below a temperature of 900° C., which temperature has experimentally be found to be low enough to prevent a rapid formation of secondary oxide. In view of the enormous heat content of the slab it is recommended to move the flat jet nozzle at least two times to and fro over the chosen region to make sure that both ends of the chosen region are under said temperature. The water used for the final cooling step can be at a much lower pressure, of e.g. 10 bars. Now that the region is conditioned, the mark can be applied, which is preferably done by spraying a mixture of paint and water substantially perpendicular to the surface. (Experiments have shown that solvent based paints produce deposits with a closed structure and tend to a burst of the paint dot. Water based paints deposit a more open structure which gives a better adhesion to the rough and hot surface. That is why water based paints are used only.)

Whereas the marking apparatus 4 in FIG. 1 provides a mark (K7645-203) in the form of characters in the well-known dotted 7×5 matrix, as shown in FIG. 1, it is found that the same characters can be sprayed along a continuous path by using only one instead of seven sprayguns, but now combined with a more complicated programming of the manipulator 4.

Figure 2:
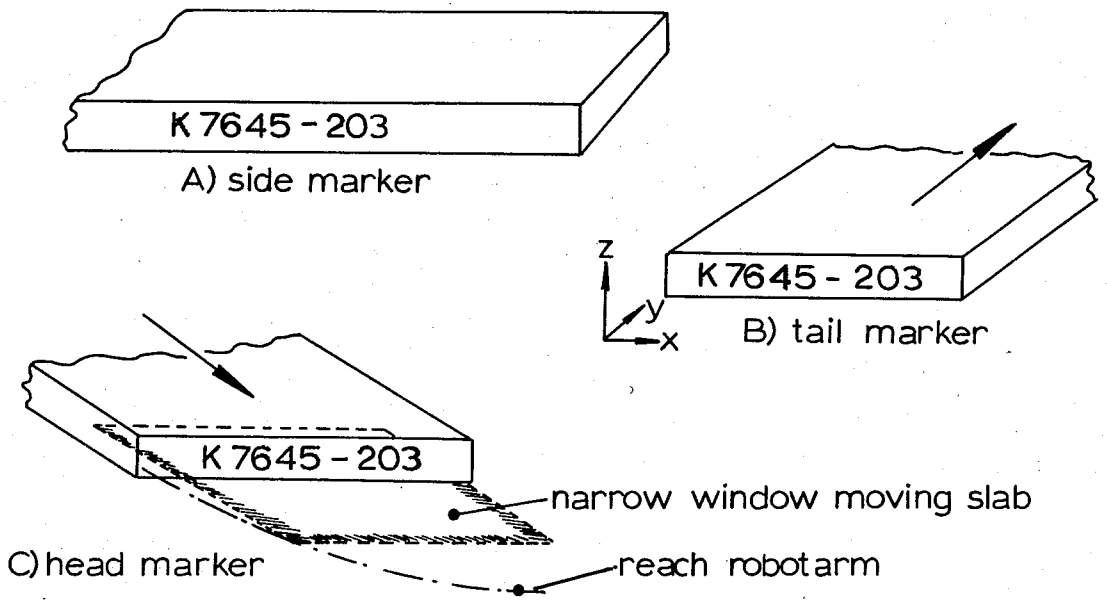
FIGS. 2*a*, 2*b* and 2*c*, respectively, show schematically in perspective parts of a steel slab with characters written on one side thereof.

The result is shown in FIG. 2, of which FIG. 2*a* shows the result at the side, FIG. 2*b* at the tail and FIG. 2*c* at the head of the slab.

The use of an industrial robot, as a re-programmable manipulator, increases the multipurpose character of the marking apparatus. The robot itself has proved to be a reliable equipment under the severe conditions of a steelplant. The heavy duty industrial robot CINCINNATI MILACRON 746 has been chosen as the basic configuration for all movements to be performed by the marker system. This robot has an electric power system and and all movements are controlled by a computer system. Programming this system may be executed by a manual performed teach-method or by an external data connection (off-line). This last facility enables the marking system to be up-dated from a databank after each applied mark.

In case of sidemarking the slab, the characters are written in the Y-Z plane of the robot system. The X-plane will be determined, as result of the search action, as a relocatable plane, see FIG. 2. In case of marking the tail end of the slab, the characters are written in the X-Z plane. The Y-plane will be determined as a result of a combined search program. First the side of the slab has to be determined, for different slab width, as a relocatable X-axis and afterwards the tail has to be found as a relocatable Y-plane. Rough positioning the slab will be controlled by hot metal detectors.

Marking the head of a moving slab (FIG. 2*c*) is more difficult in view of the limited reach of the robot arm and the narrow window available in a short time.

Figure 3:
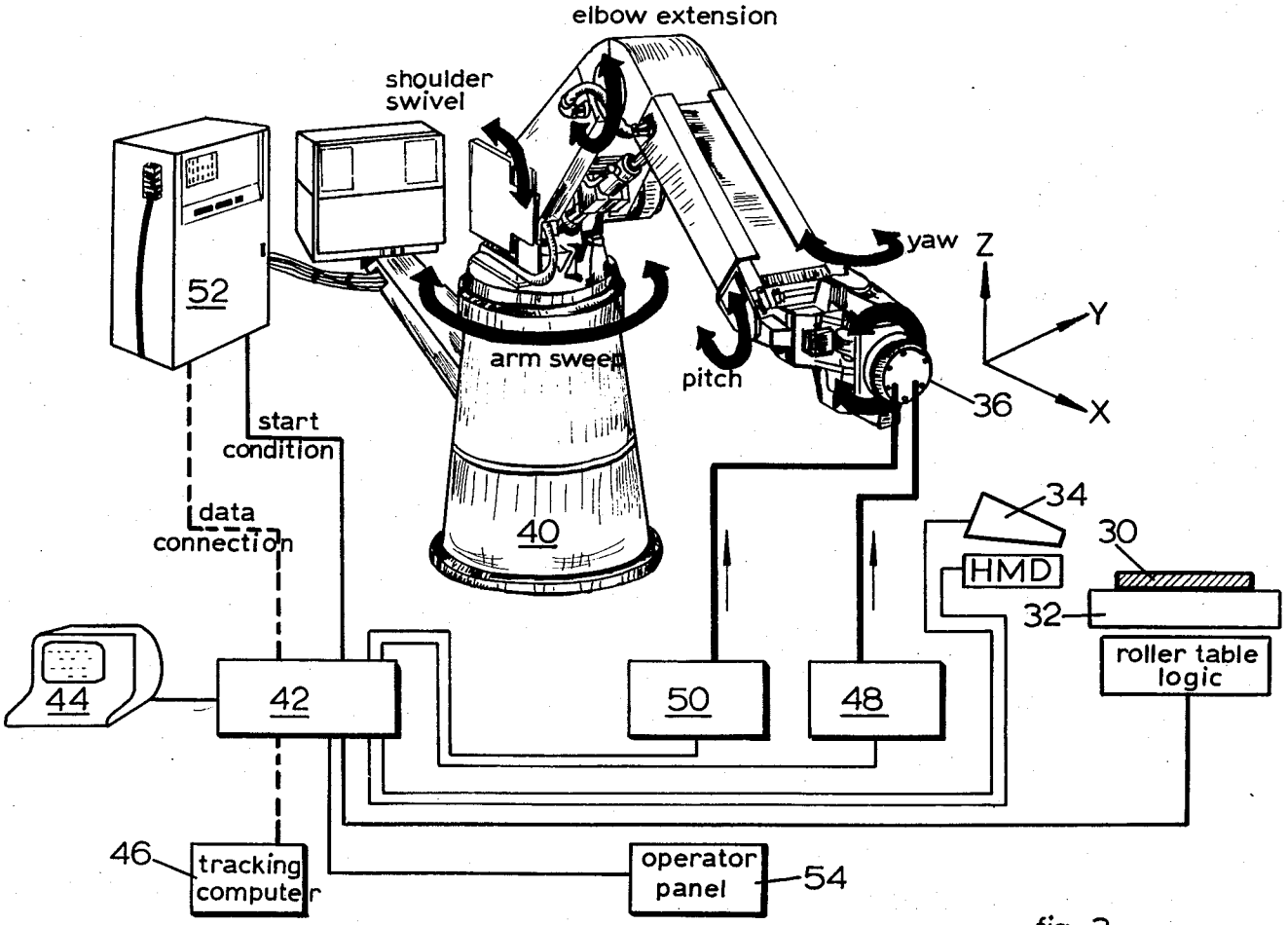
FIG. 3 represents a block diagram of the set-up of the marking apparatus with in perspective a reprogrammable manipulator or industrial robot which is preferably used and its possible movements.

In FIG. 3 is the hot slab 30 on the schematically indicated roller tabel 32. The presence of the slab 30 is detected by hot metal detector HMD and its temperature by temperature scanner 34.

The nozzles for locally descaling and cooling the slab 30 and for spray marking the slab are mounted on the hand 36 of the re-programmable manipulator or industrial robot 40.

The use of water based paints, mainly $TiO_2$ and water plus a wetting agent, gives the best results regarding the adhesion of the mark to the slab surface and its legibility even after storing of the marked slab in the open air for some months.

To reach either the side of the slab 30 or the head/tail end of the slab or even following slow moving slabs, it is necessary to bring the spray tool, as part of the robot hand 36, in the correct position and afterwards perform a movement of the tool along the desired path. Besides controlling the positions and movements of the robot hand 36, checks are required on the high pressure water system 50, the paint system 48 and the periphery, see FIG. 3. To prevent overload of the robot computer system it was decided to add a micro computer system 42, 44, 46 to control all conditions other than the robot itself. This made it possible to use a micro computer 42 as a data buffer between tracking computer 46 and robot system 40 and also to compute the marking coordinates for running hand characters.

Basically the sequence of movements of the robot hand 36 will be:

- Leave home position and swing towards the roller tabel 32.
- Search the side of the slab 30 (depending on the width of the slab).
- Retract into water-spray position and start spraying.
- Move several times along a desired track according to the required length of the mark, stop spraying. Then the part of the slab, which has to be marked has been descaled and also partly cooled.
- Moves towards the slab until marking position has been reached.
- Move along one straight line at a constant speed and control the seven sprayguns of the marking system at regular intervals (time-based) to product the required dotted characters.

Or:

- Move along a continuous path at the desired track, control one spraygun to product running hand characters.
- Return to home position.

To control the movements and functions of the robot hand 36, see FIG. 3, it is necessary to check continuously:

- the coordinates X, Y and Z, which are determined by movements like arm sweep, shoulder swivel and elbow extension;
- the orientation of the wrist defined by yaw, pitch and roll;
- the functions (tool, velocity, delay, etc.).

To teach the robot, only those points have to be stored in the memory of the robot where direction, speed or function itself will be changed. In teach-mode the operator is able to move the robot hand 36, particularly the tool center point, into a new position and orientation by pressbuttons on the pendant 52. By the keyboard 54 the required function might be added. Positions are taught points are stored in memory as coordinates in space and not as robot axis coordinates. In auto-mode the robot computer system calculates the straight line between two successive points and controls the movements along that path simultaneously by six axes, servo-controlled. The sequence of the successive steps has to be put in during teach-mode, also the possibility to jump to another branch. It is not allowed to change this during auto-mode procedure. In the same way changing functions is only permitted before the point "Cycle start" has been left in auto-mode.

Basically the descale operation was learned in teach-mode and the side of the slab (in case of different slab width) will be found by using the search option. Transforming the coordinates from absolute into relocatable enables the robot to replay this descale operation for every slabwidth without reinstruction.

The system for marking the slab is rather simple. One of the major problems of marking is keeping the spray nozzle open. Due to heat radiation the paint particles at the outside of the spray nozzle have the tendency to clog and will disturb the spray-action. This can be prevented by regular cleaning operations. Automatically this can be performed by blowing an air-solvent mixture through the nozzle tip after paint marking.

The best results for slab marking were obtained by using a water based paint ($TiO_2$, water and wetting agent). Unfortunately a further dilution of the wetting agent, due to the use of an air-water mixture for cleaning, caused a clogging inside the spraygun. Another problem occurred during a longer period of non-use. The pressure in the paint circulation system caused a squeeze of the water in the paint mixture at the inside of the nozzle tip. So a re-start was quite difficult. It was decided:

- not to use an air-water mixture for cleaning operation, but to trust in a rebound of water during descaling and cooling the slab and simultaneously cleaning the outside of the spray nozzle;
- to change the tip of the needle inside the spraygun and to increase the angle of the inner inlet towards the spray nozzle from 24° up to 80° to conquer the problem of squeezing the water from the water-based paint.

Figure 4:
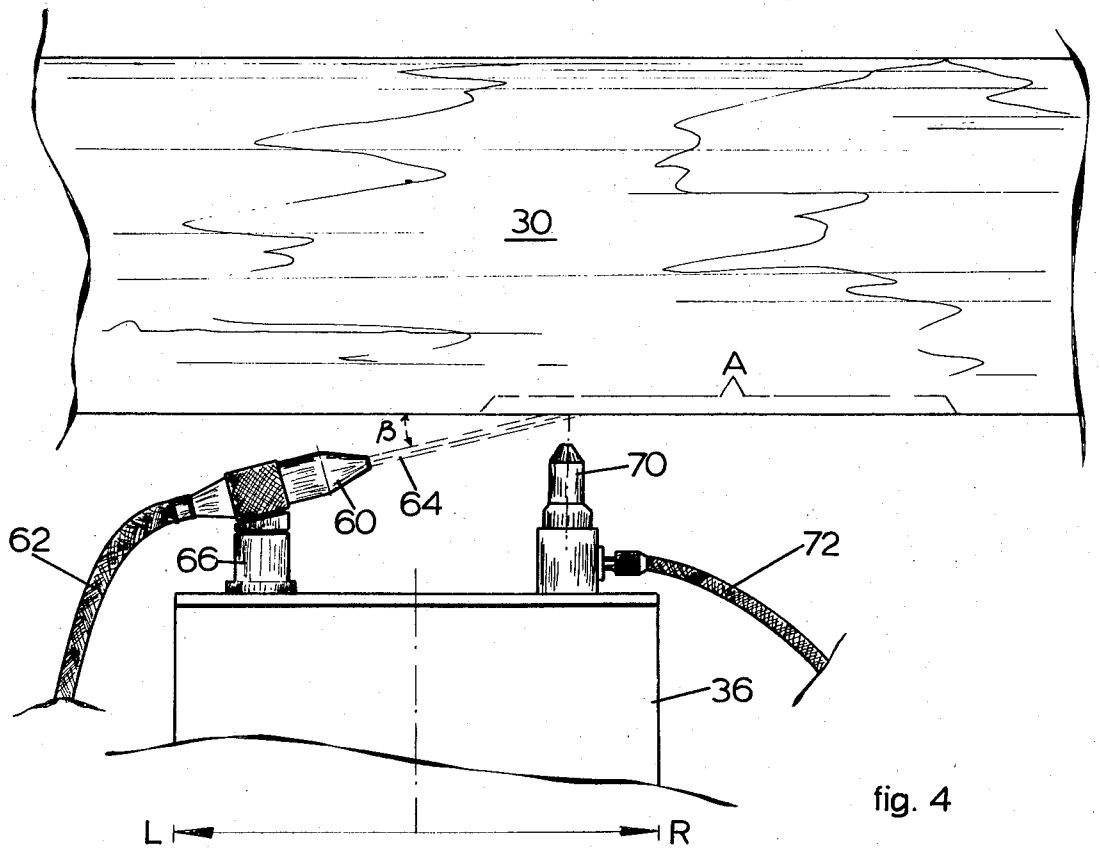
FIG. 4 shows in plan view a part of a slab and the essential parts of the marking apparatus.

FIG. 4 shows in plan view a part of a slab 30 and a part of the robot hand 36. On the hand 36 a flat jet nozzle 60 is mounted by means of a clip 66. High pressure water at a volume rate of 1.5 liter per second is supplied through a hose 62 from the pump 50 of FIG. 3. The nozzle 60 gives a flat jet 64 at an acute angle $\beta$ with the chosen surface region A of the slab 30. This angle $\beta$ lies in the range of 15°. This angle should be acute for two reasons, the water jet should reach under the oxide layers on the slab and further the rebound of the high pressure water at the slab surface may not hit the robot hand 36. The height of the flat jet in vertical direction is about 250 mm.

The high pressure of the water may be at least 140 to 150 bars, good results were obtained with a pump pressure of 190 bars. The robot hand 36 with the nozzle 60 thereon is moved to and fro to the right and to the left (R and L as shown) several times over the chosen surface A of the hot slab 30 parallel thereto, three times appeared to be the best at a uniform speed of 300 mm per second of the robot hand 36. A higher speed of the robot hand at the descaling steps did not give satisfactory results. The most important factor for the adherence of the paint is that the slab surface in region A is oxide-free before the mark is applied. The water pressure is gradually reduced to about 10 bars, to promote a further local cooling of the region A. By this to and fro movement a homogeneous temperature of below 900° C. of the skin of the slab is achieved. The duration of the descaling and cooling step is about 30 to 40 seconds, so that there is ample time available to spray a mark on the slab.

The robot hand 36 is also provided with at least one spray gun 70, which is connected by one or more hoses 72 to the paint-water system 48 of FIG. 3.

Immediately after the descaling and cooling step, the marking of the region A begins.

The optimum distance of the gun 70 to the slab surface for spraying is 3 cm. The mark is to be applied before the cooled down skin region of slab surface is again oxidized by the growth of a so-called secondary oxide layer.

It appears that high pressure water is the only means that is able to clean the slab surface so intensely that the marks have good adherence to this surface.

What is claimed is:

1. Method of marking a hot steel slab, including the step of descaling a chosen surface region at a side of the slab by directing a water jet of high pressure at an acute angle to said surface region in order to remove locally iron oxide therefrom, followed by the step of cooling down below 900° C. the so descaled surface region by directing a gentle water stream at a low pressure in order to prevent secondary oxide growth, and by the step of spraying a water-based marking composition in the required pattern on said descaled and cooled down surface region at the said side of the slab.

2. Method of marking a hot steel slab according to claim 1, wherein the pressure of the high pressure water jet lies above 150 bars and the pressure of the low pressure water stream is about 10 bars.

3. Method according to claim 1, characterized in that the high pressure water jet is a flat jet, directed at an acute angle of about 15° with the slab surface.

4. Method according to claim 2, characterized in that the high pressure jet is a flat jet, directed at an acute angle of about 15° with the slab surface.

5. Method according to claim 1, 2, 3 or 4, characterized in that the high pressure water jet is moved to and fro at least two times over the chosen surface region parallel thereto.

6. Method according to claim 5, characterized in that the high pressure water jet is moved three times over the chosen surface region at a uniform speed of about 300 mm per second.

* * * * *